US006601542B2

(12) United States Patent
Campion

(10) Patent No.: US 6,601,542 B2
(45) Date of Patent: Aug. 5, 2003

(54) CONTAINMENT SYSTEMS FOR PORTABLE POWER MODULES

(75) Inventor: Edmund Campion, Encino, CA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/045,617

(22) Filed: Oct. 23, 2001

(65) Prior Publication Data

US 2003/0029390 A1 Feb. 13, 2003

Related U.S. Application Data

(60) Provisional application No. 60/310,860, filed on Aug. 8, 2001.

(51) Int. Cl.[7] ..... F01P 1/00

(52) U.S. Cl. ..... 123/2; 290/1 R

(58) Field of Search ..... 123/2; 290/1 R

(56) References Cited

U.S. PATENT DOCUMENTS 6,450,133 B1 * 9/2002 Bernard et al. ..... 123/2

* cited by examiner

*Primary Examiner*—Noah P. Kamen
(74) *Attorney, Agent, or Firm*—Perkins Coie LLP

(57) ABSTRACT

Containment systems for use with portable power modules trailerable over public roads and capable of providing at least approximately one megawatt of electrical power. In one embodiment, the portable power module includes a shipping container housing a gaseous fuel motor drivably connected to an electrical generator. In one aspect of this embodiment, the containment system includes a containment member having a substantially horizontal portion and a plurality of substantially vertical portions contiguously and sealably attached to the horizontal portion to form a vessel. The containment member is positioned inside the container beneath the motor and the generator and extends at least substantially over the entire bottom portion of the container conforming to the interior dimensions of the container to prevent liquids, such as coolants, lubricants, and water, from leaking out of the container onto adjacent property.

20 Claims, 9 Drawing Sheets

CONTAINMENT SYSTEMS FOR PORTABLE POWER MODULES

CROSS-REFERENCE TO RELATED APPLICATION(S)

This application claims the benefit of pending U.S. Provisional Patent Application No. 60/310,860 entitled "PORTABLE POWER MODULES AND RELATED SYSTEMS," which was filed Aug. 8, 2001, and is incorporated herein by reference. This application cross-references pending U.S. patent application entitled "AIR DUCTS FOR PORTABLE POWER MODULES," U.S. patent application entitled "AIR PROVISION SYSTEMS FOR PORTABLE POWER MODULES," U.S. patent application entitled "FREQUENCY SWITCHING SYSTEMS FOR PORTABLE POWER MODULES," and U.S. patent application entitled "PORTABLE POWER MODULES AND RELATED SYSTEMS," filed concurrently herewith and incorporated herein by reference.

BACKGROUND

The described technology relates generally to containment systems for portable power modules and, more particularly, to liquid containment systems for containing liquids within portable power modules trailerable over public roads and capable of providing at least approximately one megawatt of electrical power.

There are many occasions when temporary electrical power may be required. Common examples include entertainment and special events at large venues. As the demand for energy quickly outstrips supply, however, temporary electrical power is being used in a number of less common applications. For example, as electrical outages occur with increasing regularity, many commercial enterprises are also turning to temporary electrical power to meet their demands during peak usage periods.

A number of prior art approaches have been developed to meet the rising demand for temporary electrical power. One such approach is a mobile system that generates electrical power using a liquid fuel motor, such as a diesel fuel motor, drivably coupled to an electrical generator. This system is capable of producing up to two megawatts of electrical power and can be housed within a standard shipping container, such as a standard 40-foot ISO (International Standard Organization) shipping container. Enclosure within a standard shipping container enables this system to be quickly deployed to remote job sites using a conventional transport vehicle, such as a typical tractor truck.

Temporary electrical power systems that use liquid fuels, such as petroleum-based fuels, however, have a number of drawbacks. One drawback is associated with the motor exhaust, which may include undesirable effluents. Another drawback is associated with the expense of procuring and storing the necessary quantities of liquid fuel. As a result of these drawbacks, attempts have been made to develop temporary electrical power systems that use gaseous fuels, such as natural gas.

One such attempt at a gaseous fuel system is illustrated in FIG. 1, which shows a side elevational view of a power generation system 100 in its normal operating configuration. The power generation system 100 includes a motor 110 drivably coupled to a generator 120. The motor 110 is configured to burn a gaseous fuel, such as natural gas, and is capable of mechanically driving the generator 120 to produce an electrical power output on the order of one megawatt. The motor 110 and generator 120 are housed within a standard 40 foot ISO shipping container 102, which is supported by a trailer 103 having a tandem axle rear wheel-set 104. The trailer 103 can be coupled to a typical transport vehicle, such as a tractor truck, for movement of the container 102 between job sites.

Unlike their diesel fuel powered counterparts, gaseous fuel power generation systems of the prior art, such as that shown in FIG. 1, have an exhaust gas silencer 114 and a motor coolant radiator 118 installed on top of the container 102 during normal operation. This configuration is dictated by a number of factors, including the size of the gaseous fuel motor 110 and the amount of heat it gives off during operation. The size of the motor 110 reduces the space available inside the container 102 for the exhaust gas silencer 114 and the radiator 118, and the large amount of heat generated by the motor creates an unfavorable thermal environment inside the container for the radiator. Although the exhaust gas silencer 114 and the radiator 118 are installed on top of the container 102 during normal operation, during movement between job sites these components are removed from the top of the container to facilitate travel over public roads.

During normal operation, an air moving system 143 draws ambient air into the container 102 through a first air inlet 130 on one side of the container and a complimentary second air inlet 132 on the opposing side of the container. This ambient air is used for cooling of the motor 110 and the generator 120 and for combustion in the motor. The portion of this air used for cooling, identified as air 131, is discharged out the back of the container 102 by the air moving system 143.

A number of shortcomings are associated with the prior art power generation system 100. One shortcoming is the number of transport vehicles required to deploy the power generation system 100 to a given job site. For example, although the container 102 with the motor 110 and the generator 120 inside can be transported to the job site using only one transport vehicle, an additional transport vehicle is also required to carry the exhaust gas silencer 114 and the radiator 118. In addition, once at the job site, both the exhaust gas silencer 114 and the radiator 118 need to be installed on top of the container 102 and the necessary structural and functional interfaces connected and verified. The exhaust gas silencer 114 and the radiator 118 must then be removed from the top of the container 102 when it comes time to move the power generation system 100 to a second job site.

Additional shortcomings are associated with the configuration of the prior art power generation system 100. For example, placement of the radiator 118 on top of the container 102 causes any coolant leaking from the radiator to flow onto the top of the container. This coolant may then find its way undesirably onto the ground adjacent to the portable power module. Similarly, onboard liquids, such as lubricants and coolant that may leak from the engine 110, as well as rainwater brought in through the first and second air inlets 130 and 132, may collect inside the container 102 during periods of operation. These liquids can also leak onto the adjacent ground through various fastener holes or seams in the bottom of the container 102.

The foregoing shortcomings of the prior art power generation system 100 offset many of the benefits associated with such a system. Therefore, a temporary electrical power generation system that uses gaseous fuel and has the ability to provide at least approximately one megawatt of electrical power without these shortcomings would be desirable.

DETAILED DESCRIPTION

The following disclosure provides a detailed description of containment systems for preventing liquids onboard a portable power module from leaking onto adjacent property. Such liquids may include coolants, lubricants, and water that has either condensed inside the container or has entered through an aperture. In one embodiment, the containment system is useable with a portable power module that includes a shipping container housing a gaseous fuel motor drivably connected to an electrical generator. The electrical generator is capable of providing at least approximately one megawatt of electrical power when driven by the motor at a selected RPM. The containment system of this embodiment includes a containment member having a base portion and a plurality of upstanding portions contiguously and sealably attached to the base portion. In one aspect of this embodiment, the containment member is positioned inside the container beneath the motor and the generator and extends at least substantially over the entire bottom portion of the container conforming to the interior dimensions of the container. The containment member is shaped and sized so that it can contain at least approximately 120 percent of the liquids onboard the portable power module during normal operation. In a further aspect of this embodiment, the containment system can include one or more drain outlets for draining liquids and other substances that may collect in the containment member over time.

Many specific details of certain embodiments of the invention are set forth in the following description to provide a thorough understanding of these embodiments. One skilled in the relevant art, however, will understand that the present invention may have additional embodiments, or that the invention may be practiced without several of the details described below. In other instances, structures and functions well known to those of ordinary skill in the relevant art have not been shown or described in detail here to avoid unnecessarily obscuring the description of the embodiments of the invention.

Figure 2:
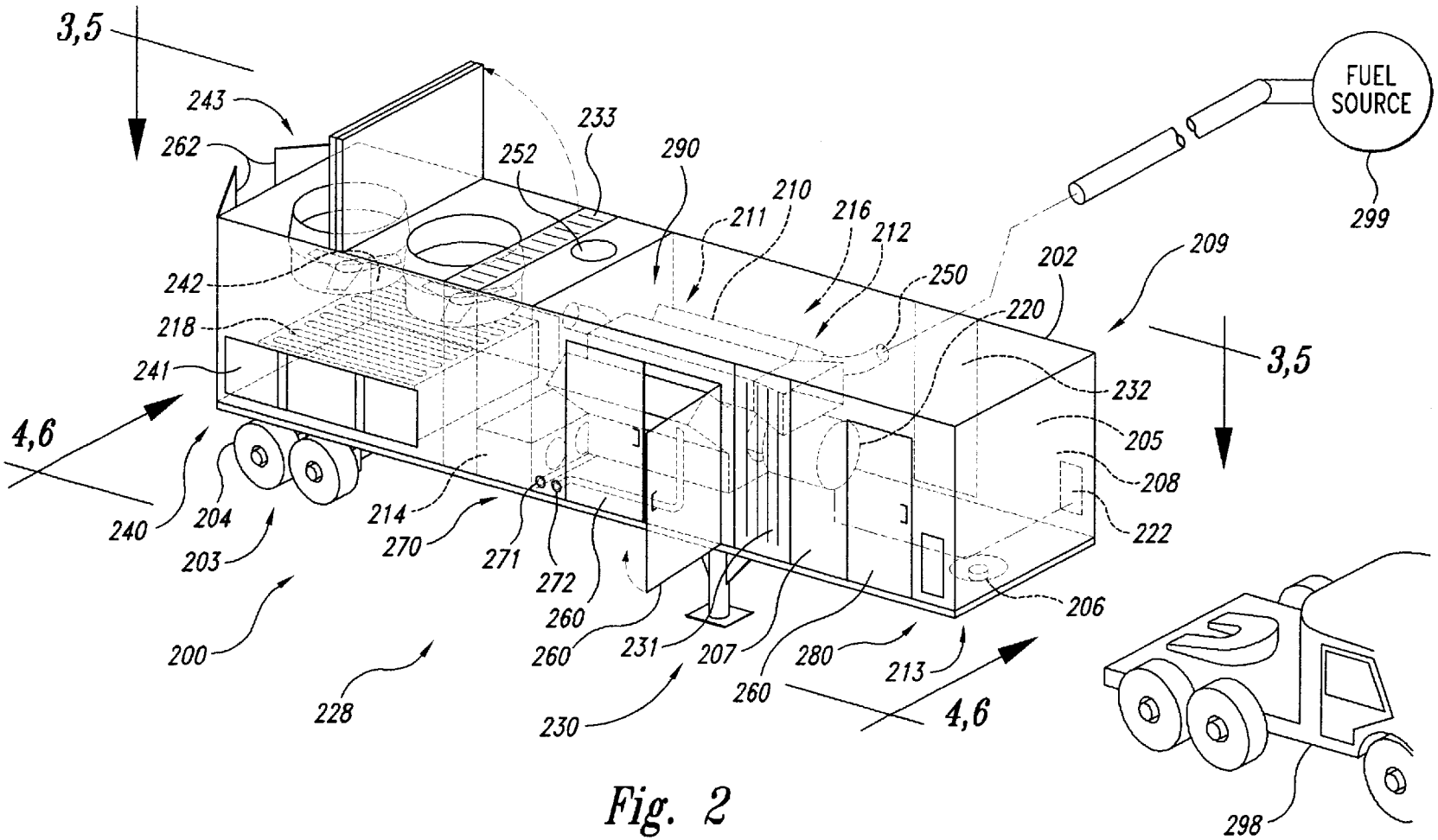
FIG. 2 is an isometric view of a portable power module in accordance with an embodiment of the invention.

FIG. 2 is an isometric view of a portable power module 200 in accordance with an embodiment of the invention. In one aspect of this embodiment, the portable power module 200 includes a container 202 defining a first interior portion, or motor compartment 205, toward a first direction 225, and a second interior portion, or radiator compartment 215, toward a second direction 226 opposite to the first direction. In the motor compartment 205, the container 202 houses a gaseous fuel motor 210 drivably connected to a generator 220 that provides electrical power to an electrical outlet 222. In the radiator compartment 215, the container 202 houses a horizontally situated radiator 218 connected in flow communication with a motor coolant jacket 212. When the motor 210 is operating, the radiator 218 receives heated coolant from the coolant jacket 212 and returns cooled coolant to the coolant jacket. A rectangular exhaust gas silencer 214 connected in flow communication with a motor exhaust gas manifold 216 receives exhaust gases from the exhaust gas manifold and vertically discharges the gases through an exhaust gas outlet 252. In a further aspect of this embodiment, the motor 210, the generator 220, the radiator 218 and exhaust gas silencer 214 are all positioned within the container 202 when the portable power module 200 is in a normal operating configuration. As used throughout this disclosure, the phrase "normal operating configuration" refers to a configuration in which the portable power module 200 can provide at least approximately one megawatt of electrical power.

The container 202 includes a first side portion 207 spaced apart from an opposing second side portion 208 and a bottom portion 213 spaced apart from an opposing top portion 209. The bottom and top portions 213 and 209 are connected to the first and second side portions 207 and 208 to at least partially define the motor compartment 205 and the radiator compartment 215. The container 202 is supported on a conventional trailer 203 having a tandem axle rear wheel-set 204 for mobility. A trailer coupling 206 is forwardly positioned on a bottom portion of the trailer 203 for releasably connecting the trailer to a suitable transport vehicle 298, such as a tractor truck, for movement of the portable power module on public roads.

In one embodiment, the container 202 has the dimensions of a standard 40-foot ISO certified steel container. As is known, standard 40-foot ISO containers such as this are a ubiquitous form of shipping container often seen on roadway, railway and maritime conveyances. The standard 40-foot ISO container has a length dimension of forty feet, a width dimension of 8 feet and a height dimension of 8.5 feet.

In one embodiment, an air provision system 228 provides necessary ambient air to the portable power module 200 during operation. The air provision system 228 includes a first air circuit 230 and a second air circuit 240. The first air circuit 230 provides ambient air to the motor compartment 205 through a first air inlet 231 positioned on the first container side 207 and an opposing second air inlet 232 positioned on the second container side 208. This ambient air serves a number of purposes, including cooling the generator 220, providing air to the motor 210 for combustion, and providing general ventilation to the motor compartment 205. As will be explained in greater detail below, a portion of the ambient air entering the motor compartment 205 through the first and second air inlets 231 and 232 exits the portable power module 200 through a first air outlet 233 positioned on the top portion 209 of the container 202.

The second air circuit 240 draws ambient air into the radiator compartment 215 through a third air inlet 241 positioned on the first container side 207 and an opposing fourth air inlet 242 positioned on the second container side 208. This ambient air passes over the radiator 218 before discharging vertically through a second air outlet 243 positioned on the top portion 209 of the container 202. Accordingly, the ambient air provided by the second air circuit 240 convects heat away from the radiator 218 to lower the temperature of coolant received from the coolant jacket 212 before returning the cooled coolant to the coolant jacket. As will be explained in greater detail below, the container 202 may be adapted to include one or more occluding members optionally positionable over the second air outlet 243 to restrict the ingress of rain or other undesirable substances.

The portable power module 200 can include various interfaces positioned on the container 202 to operatively and releasably connect the portable power module to other systems. For example, a fuel inlet 250 is provided on the second container side 208 for receiving gaseous fuel, such as natural gas, propane, or methane, from a fuel source 299 and providing the gaseous fuel to the motor 210. A heat recovery system 270 can be provided on the first container side 207 to take advantage of the heat generated by the motor 210. The heat recovery system 270 includes a heat recovery outlet 271 and a heat recovery return 272. Both the heat recovery outlet 271 and the heat recovery return 272 are connected in flow communication to the coolant jacket 212 on the motor 210. In one aspect of this embodiment, the heat recovery outlet 271 and the heat recovery return 272 are releasably connectable to a separate circulation system (not shown) for circulating the hot coolant produced by the motor 210. This hot coolant flows out through the heat recovery outlet 271 and can provide heat for various useful purposes before returning to the coolant jacket 212 through the heat recovery return 272.

The portable power module 200 of the illustrated embodiment can also include a number of doors for operator access. For example, one or more side doors 260 can be provided so that an operator can enter the motor compartment 205 to operate the portable power module 200 or to provide maintenance. Similarly, one or more end doors 262 can also be provided for operator access to the radiator 218 and related systems.

A containment system 280 is disposed adjacent to the bottom portion 213 of the container 202. In the illustrated embodiment, the containment system 280 extends substantially over the entire planform of the container 202 to prevent spillage of fluids from the portable power module 200 onto adjacent premises. For example, the containment system 280 may capture fuels or lubricants that may leak from the motor 210 over time. In addition, the containment system 280 may also capture rainwater that has entered the portable power module 200 through the second air outlet 243 or other apertures.

As those of ordinary skill in the relevant art are aware, different parts of the world use different frequencies of electrical power for their electrical equipment. For example, much of the world (e.g., Europe) uses 50 Hz electrical power, while other parts (e.g., the United States) use 60 Hz. To accommodate this difference, the portable power module 200 of the illustrated embodiment includes a frequency switching system 290 for selectively switching the frequency of the electrical power output between 50 Hz and 60 Hz. In one embodiment, the frequency switching system 290 includes a turbocharger 211 that is operatively connected to the motor 210 and has interchangeable components that allow selecting between a 50 Hz configuration or a 60 Hz configuration. The selected turbocharger configuration determines the speed, or the revolutions per minute (RPM), of the motor 210, which in turn determines the frequency of the electrical power generated by the generator 220. Accordingly, the electrical power provided by the portable power module 200 can be provided in either 50 Hz or 60 Hz form by selecting the appropriate turbocharger configuration.

The portable power unit 200 of the illustrated embodiment can use a number of different types of motors and generators. For example, in one embodiment, the portable power module 200 can use a gaseous fuel-burning reciprocating motor, such as the J 320 GS-B85/05 motor manufactured by Jenbacher AG. In another aspect of this embodiment, the generator can be an HCI 734 F2 generator manufactured by the Stamford Company. In other embodiments, other motors and other generators can be employed.

In one embodiment, the portable power module 200 can be used to provide temporary electrical power at a remote site as follows. After a customer has placed an order for temporary electrical power, the operator deploys the portable power module 200 to the designated site. Deployment includes releasably attaching the coupling 206 to the transport vehicle 298 and transporting the portable power module 200 to the site. During transport, the various doors (e.g., 260, 262) and covers (e.g., over the first air outlet 233, the second air outlet 243, and the exhaust gas outlet 252) should be closed. Upon arrival at the site, the transport vehicle 298 can be uncoupled from the portable power module 200 and can leave the site. Before operating the portable power module 200, the fuel source 299, such as a natural gas source, is connected to the fuel inlet 250, and the second air outlet 243, the exhaust gas outlet 252, and the first air outlet 233 are uncovered. In this normal operating configuration, the motor 210 can be started and the portable power module 200 can provide at least approximately one megawatt of electrical power to the electrical outlet 222 for use by the customer.

Figure 1:
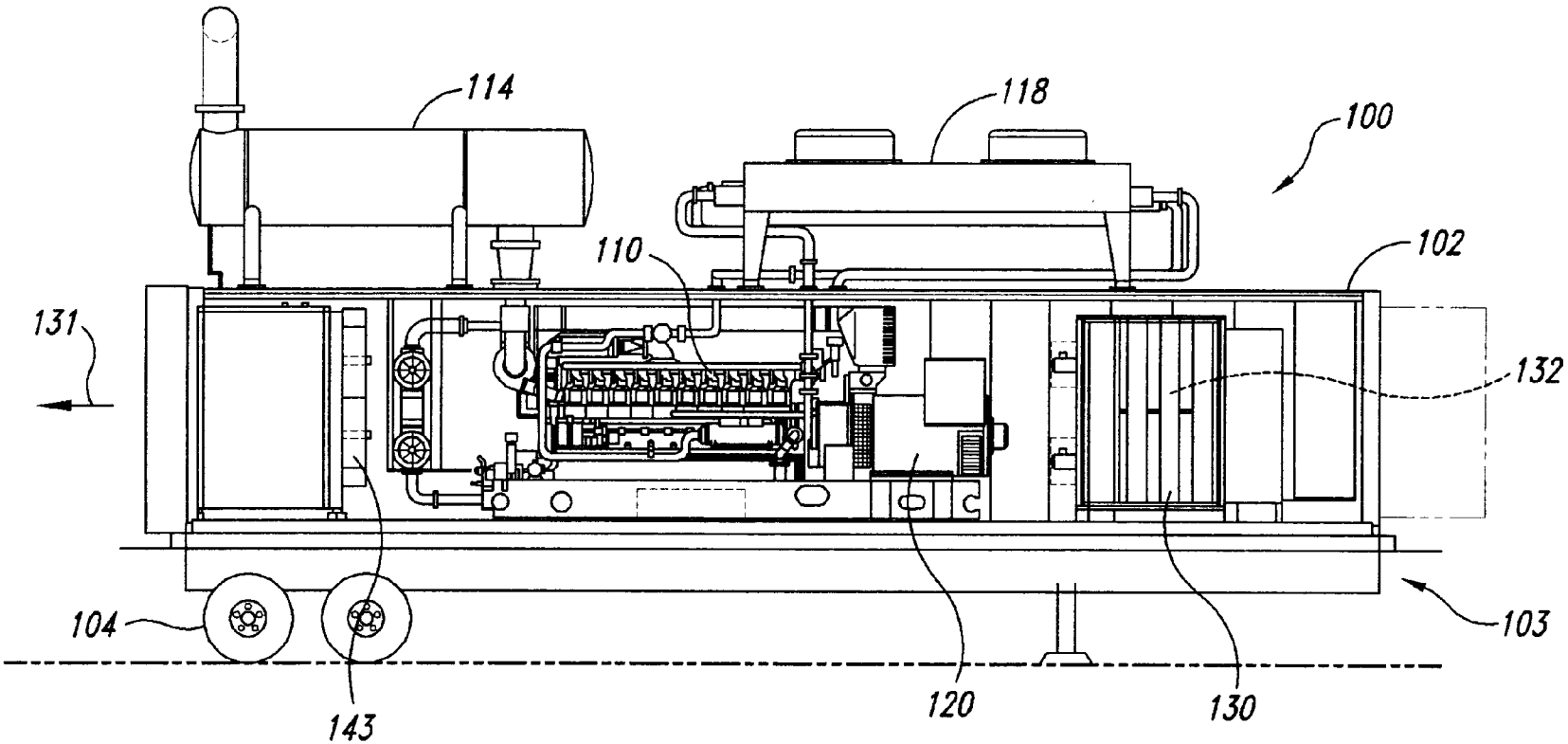
Fig. 1 (Prior Art)
FIG. 1 illustrates an electrical power generation system in accordance with the prior art.

The portable power module 200 has a number of advantages over the power generation systems of the prior art, such as the prior art system shown in FIG. 1. For example, because the fully assembled, operable portable power module 200 fits entirely within a standard 40-foot ISO shipping container, it complies with applicable U.S. Department of Transportation (DOT) standards for travel over public roads. Further, in the embodiment illustrated in FIG. 2, the gross weight of the container 202 including its internal components does not exceed 53,000 pounds, and the portion of that 53,000 pounds that is positioned over the tandem rear axle wheel-set 204 does not exceed 34,000 pounds. As a result, the gross vehicle weight of the portable power module 200 combined with the transport vehicle (not shown) will usually not exceed 80,000 pounds, thereby complying with applicable DOT weight standards for travel over public roads. Because of these advantages, the portable power module 200 can be easily deployed to a remote job site over public roads using only a single transport vehicle. In addition, because the major systems associated with the portable power module 200 (e.g., motor 210, generator 220, radiator 218, exhaust gas silencer 214, etc.) are installed within the container 202 in their normal operating configuration, only minimal set-up and check-out of the systems is required at the site before operation.

A further advantage of the portable power module 200 is that, as presently configured, it can produce at least approximately one megawatt of electrical power while not generating excessive sound pressure levels. For example, the portable power module 200 of the illustrated embodiment is expected to not exceed a sound pressure level of approximately 74 db(A) at a distance of at least approximately 23 feet from the portable power module during normal operation. This ability to attenuate operational noise is attributable to the positioning of the various outlets (e.g., 233, 243, and 252) on the top portion 209 of the container 202 and other noise reduction features. As a result of the relatively low operating noise, the portable power module 200 is compatible for use in populated areas or other applications with noise restrictions.

A further advantage of the portable power module 200 is provided at least in part by the air provision system 228 that enables the portable power module to produce at least approximately one megawatt of electrical power in a wide range of ambient temperature conditions. For example, it is expected that the portable power module 200 can provide full-rated power at 50 Hz in 93 degree Fahrenheit ambient temperature conditions and at 60 Hz in 107 degree Fahrenheit ambient temperature conditions. In addition to the foregoing benefits, the portable power module 200 can also operate on gaseous fuel, such as natural gas, propane, or methane, rather than liquid fuel, such as diesel fuel. This further benefit means that the portable power module 200 may produce less of the undesirable effluents often associated with liquid fuels.

Figure 3:
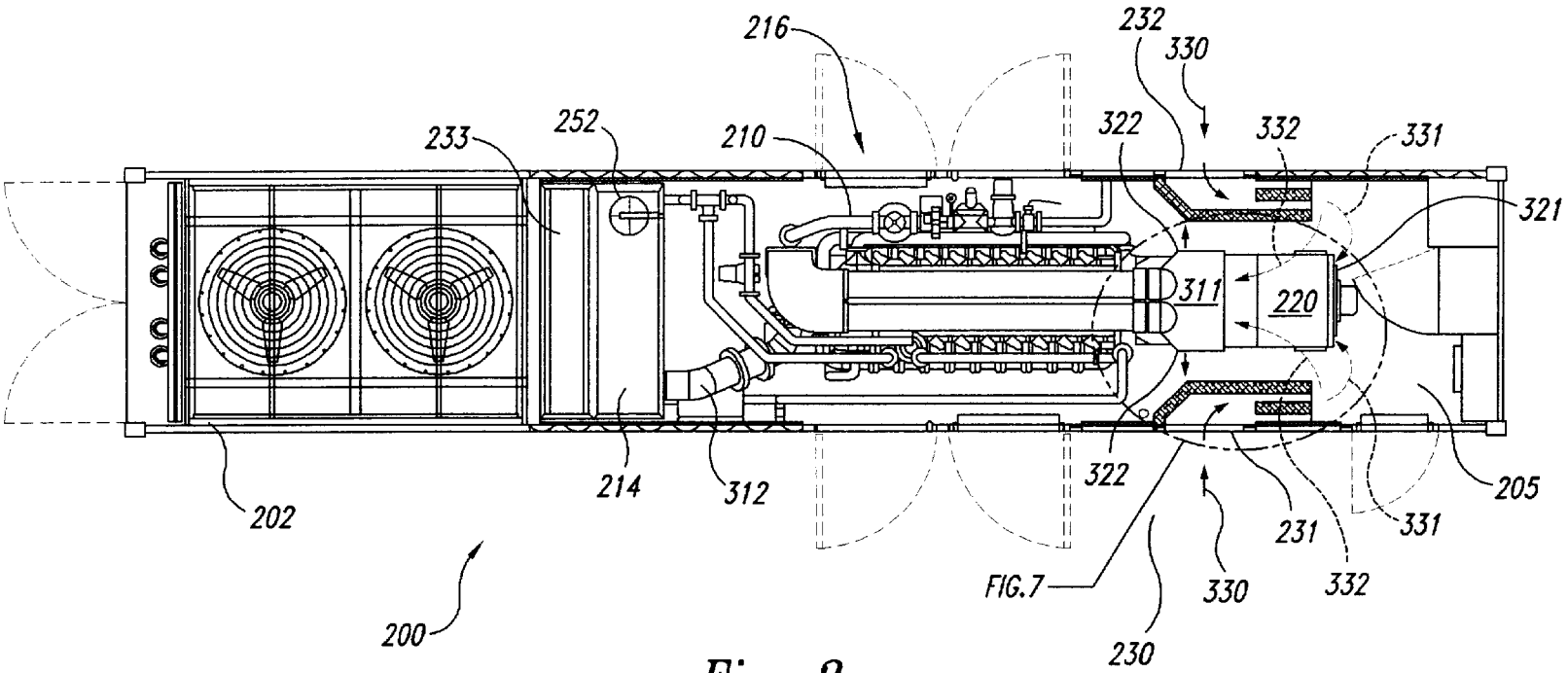
FIG. 3 is a top view of the portable power module of FIG. 2 taken substantially along line 3—3 in FIG. 2 with a roof panel removed for purposes of clarity.
Figure 4:
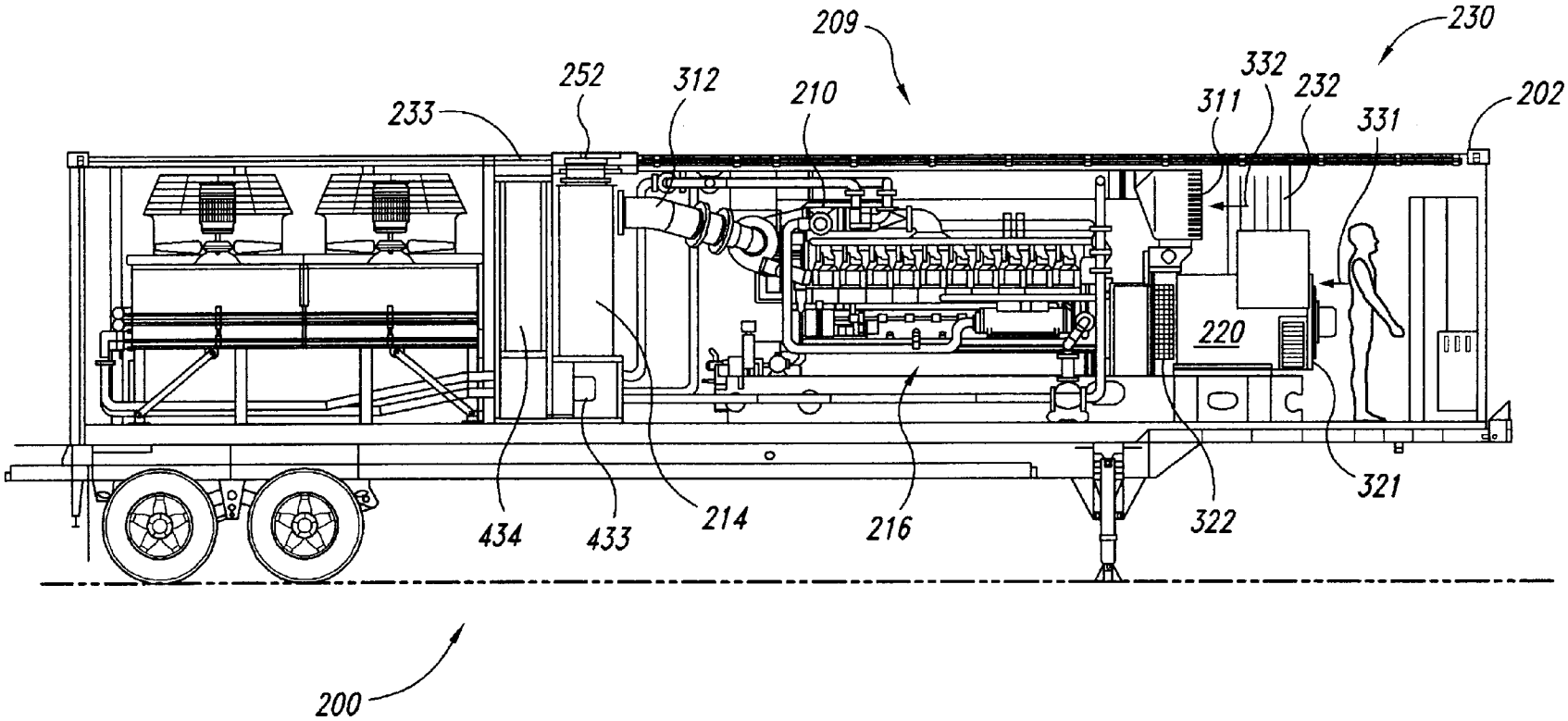
FIG. 4 is a side-elevational view of the portable power module of FIG. 2 taken substantially along line 4—4 in FIG. 2 with a side panel removed for purposes of clarity.

FIG. 3 is a top view of the portable power module 200 taken substantially along line 3—3 in FIG. 2, and FIG. 4 is a side-elevational view of the portable power module taken substantially along line 4—4 in FIG. 2. Portions of the container 202 are shown at least partially removed in FIGS. 3 and 4 for purposes of clarity. Collectively, FIGS. 3 and 4 illustrate various aspects of the first air circuit 230 in accordance with an embodiment of the invention.

As best seen in FIG. 3, a first air portion 330 enters the motor compartment 205 through the first air inlet 231 and the second air inlet 232. A first fraction 331 of the first air portion 330 is drawn into a generator air intake 321 to cool the generator 220. This generator cooling air is exhausted out of a generator air outlet 322, as shown in FIGS. 3 and 4. A second fraction 332 of the first air portion 330 is drawn into a combustion air intake 311 that provides air to the motor 210 for combustion. As shown in FIG. 4, the combustion air intake 311 is positioned upstream of the generator air outlet 322 to ensure fresh, cool air is provided to the motor 210 and not the warm air exhausting from the generator air outlet. After combustion, exhaust gases leaving the exhaust gas manifold 216 of the motor 210 pass through a circular exhaust gas duct 312 into the exhaust gas silencer 214 before being vertically discharged through the exhaust gas outlet 252.

A portion of the air entering the motor compartment 205 through the first and second air inlets 231 and 232 is not drawn into either the generator air intake 321 or the combustion air intake 311. Instead, this portion is used for general ventilation and cooling of the motor compartment 205 and is moved through the motor compartment by a first air moving system 433 (FIG. 4). The first air moving system 433 draws the air from the motor compartment 205 into a rectangular air outlet silencer 434 proximally disposed adjacent to the exhaust gas silencer 214. In one aspect of this embodiment, the first air moving system 433 can be a fan induction system positioned below the exhaust gas silencer 214 just upstream of the air outlet silencer 434. In another aspect of this embodiment, the air outlet silencer 434 is positioned in thermal proximity to the exhaust gas silencer 214 so that air passing through the air outlet silencer passes adjacent to the exhaust gas silencer 214 and convectively reduces the temperature of exhaust gasses passing through the adjacent exhaust gas silencer. Similarly, the proximity of the first air outlet 233 to the exhaust gas outlet 252 promotes mixing of cooling air with exhaust gases to further reduce the exhaust gas temperature exterior of the container 202.

One advantage of the first air circuit 230 of the embodiment shown in FIGS. 3 and 4 is the general compactness provided by the arrangement of the respective components. For example, rather than install an exhaust gas silencer on top of the container 202, the portable power module 200 of the present invention mounts the exhaust gas silencer 214 inside the container. As a result, the exhaust gas silencer configuration of the present invention does not require separate transportation to a job site nor does it require the extensive setup and check-out procedures often associated with prior art systems. Another advantage of the present invention results from locating the exhaust gas silencer 214 in thermal proximity to the air outlet silencer 434 to enhance the reduction of exhaust gas temperatures.

Figure 5:
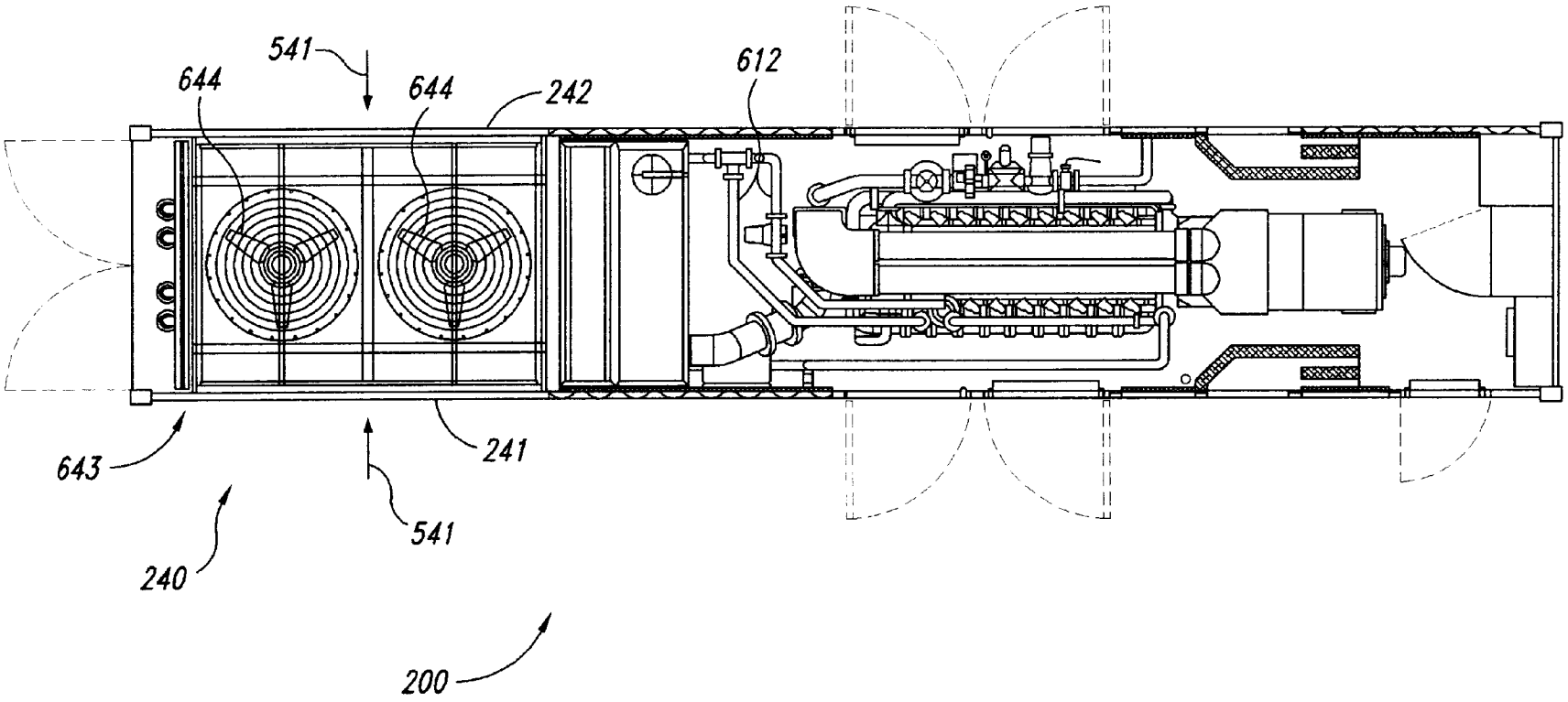
FIG. 5 is a top view of the portable power module of FIG. 2 taken substantially along line 5—5 in FIG. 2 with a roof panel removed for purposes of clarity.
Figure 6:
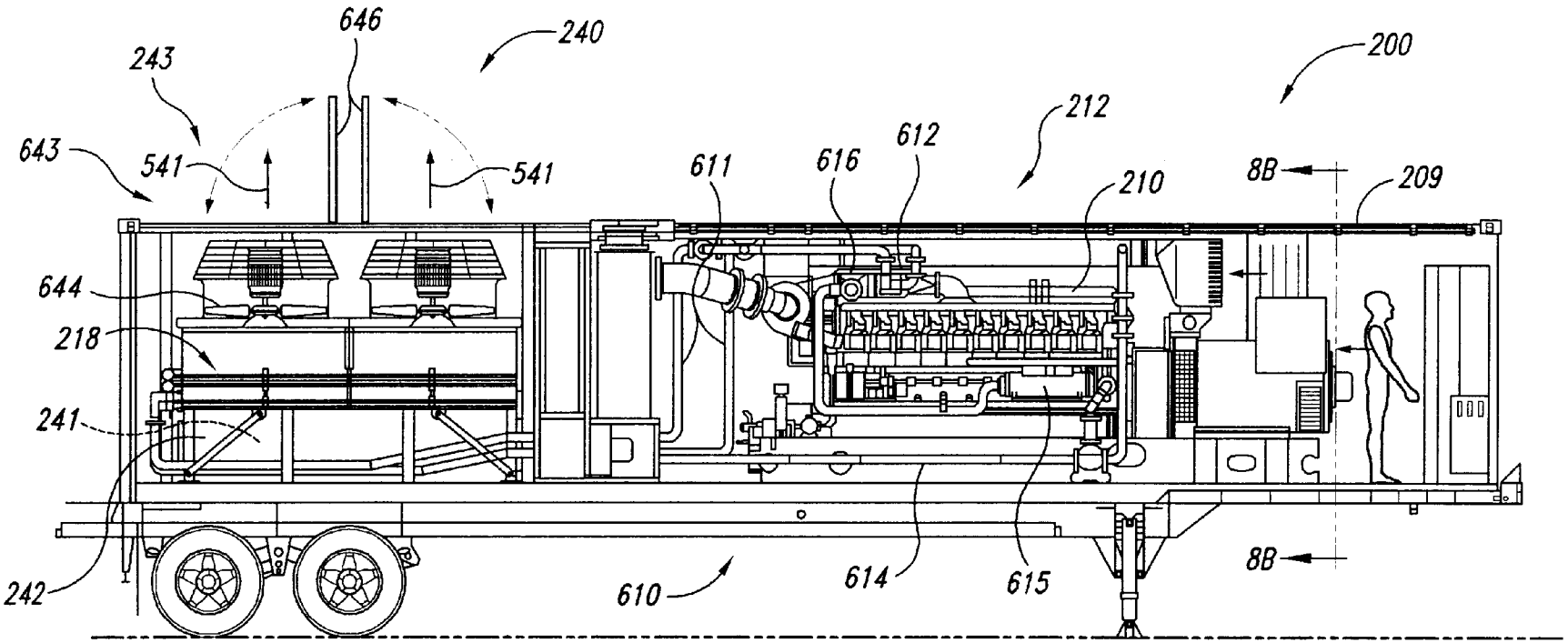
FIG. 6 is a side-elevational view of the portable power module of FIG. 2 taken substantially along line 6—6 in FIG. 2 with a side panel removed for purposes of clarity.

FIG. 5 is a top view of the portable power module 200 taken substantially along line 5—5 in FIG. 2, and FIG. 6 is a side-elevational view of the portable power module taken substantially along line 6—6 in FIG. 2. Portions of the container 202 are omitted from FIGS. 5 and 6 for purposes of clarity. Together FIGS. 5 and 6 illustrate various aspects of the second air circuit 240 in accordance with an embodiment of the invention. FIGS. 5 and 6 are at least substantially similar to FIGS. 3 and 4, respectively, except that different components may be labeled for purposes of discussion.

Referring to FIGS. 5 and 6 together, the second air circuit 240 includes a second air moving system 643 that draws a second air portion 541 horizontally through the third and fourth air inlets 241 and 242. In one embodiment, the second air moving system 643 includes two fans 644 positioned horizontally above the radiator 218. The fans 644 draw the second air portion 541 over the radiator 218 to convectively lower the temperature of coolant circulating through the radiator. After passing over the radiator 218, the second air portion 541 is discharged vertically out the second air outlet 243 (FIG. 6) located on the top portion 209 of the container 202.

As best seen in FIG. 6, the radiator 218 is connected in flow communication with a coolant circuit 610. The coolant circuit 610 includes a low temperature circuit 611 and a high temperature circuit 614. The high temperature circuit 614 circulates coolant through an oil cooler 615, an intercooler first stage 616, and the coolant jacket 212. The low temperature circuit 611 circulates coolant to an intercooler second stage 612.

In one embodiment, the second air circuit 240 includes occluding members 646 that are optionally positionable over the second air outlet 243 when the second air circuit is not in use. In the illustrated embodiment, the occluding members 646 are pivoting cover members that are pivotally attached to the top portion 209 of the container 202 adjacent to the second air outlet 243. The occluding members 646 are optionally rotatable between a substantially horizontal position in which at least a portion of the second air outlet 243 is covered to prevent ingress of rain or other substances and a substantially vertical position in which the second air outlet is substantially open to permit full discharge of the third air portion 541. In one aspect of this embodiment, electrical actuators (not shown) can be interconnected between the occluding members 646 and an adjacent structure, such as the top portion 209 of the container 202, to automatically verticate the occluding members when the motor 210 is started. Similarly, these electrical actuators can be configured to automatically rotate the occluding members 646 back into a closed position when the motor 210 is turned off.

One advantage of the second air circuit 240 as shown in FIGS. 5 and 6 is the general compactness provided by the arrangement of the respective components. For example, rather than install a motor coolant radiator on top of the container 202, the radiator 218 of the present invention is permanently installed inside the container. As a result, the radiator configuration of the present invention does not require separate transportation to a job site, nor does it require the extensive set-up and check-out procedures often associated with prior art systems.

One advantage of the portable power module 200 is the noise reduction resulting from the configuration of the first and second air circuits 230 and 240. As explained under FIGS. 3 and 4, the first air circuit 230 provides air to the motor compartment 205, and the second air circuit 240 provides air to the radiator 218. By using two air circuits instead of one, the individual air demands of each circuit are necessarily less than the total air demand would be for a single circuit that provided air to both the motor compartment 205 and the radiator 218. As a result, the air flow speeds at the first and second air inlets 231 and 232, and the third and fourth air inlets 241 and 242, can be substantially lower than prior art systems that use a single air circuit. This reduction in air speed results in a substantial reduction in air noise at the respective inlets. This reduction in air speed has the further advantage of reducing the amount of rainwater drawn into the container 202 during operation in the rain.

A further advantage of the portable power module 200 is the efficiency of radiator cooling it provides. Power generation systems of the prior art, such as those that use diesel fuel, use a single air circuit for both motor compartment and radiator cooling. As a result, with prior art systems either the radiator or the motor will not receive cool ambient air. For example, if the single air circuit first draws outside air through the motor compartment and then passes it to the radiator, then the radiator would receive preheated air. Conversely, if the air was first drawn over the radiator and then passed to the motor compartment, then the motor would receive preheated air. In contrast, the portable power module 200 of the present invention uses two dedicated air circuits, such that both the motor compartment 205 and the radiator 218 are provided with cool ambient air.

Figure 7:
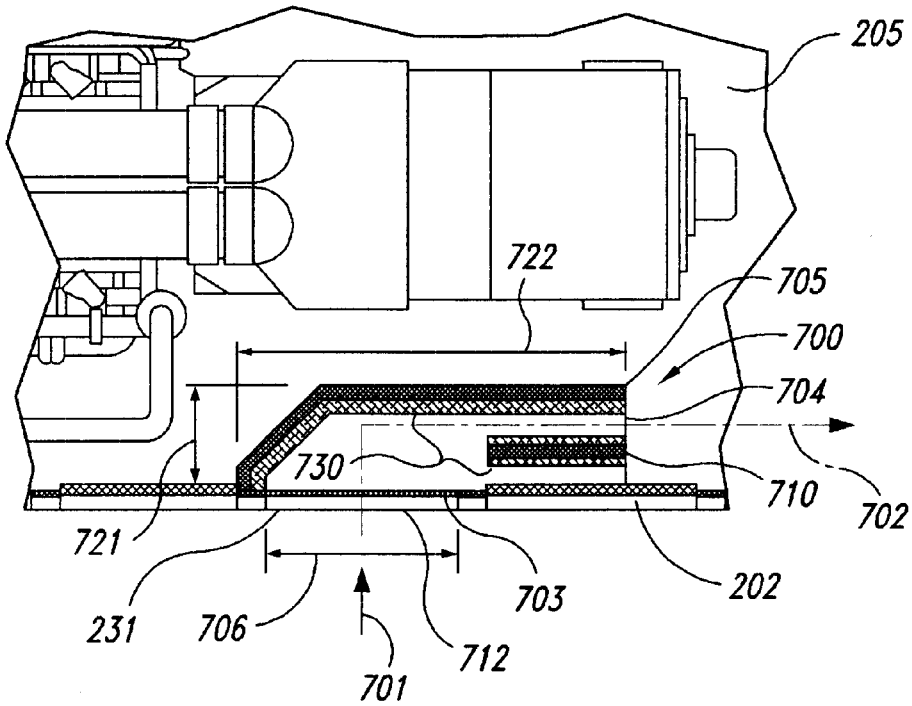
FIG. 7 is an enlarged top view of an air duct in the portable power module of FIG. 3 in accordance with an embodiment of the invention.

FIG. 7 is an enlarged top view of an air duct 700 in the portable power module of FIG. 3 in accordance with an embodiment of the invention. In the embodiment shown in FIG. 7, the air duct 700 is an air inlet duct mounted to the inside of a container, such as the container 202, in flow communication with an air inlet, such as the first air inlet 231. In one aspect of this embodiment, the air duct 700 introduces ambient air into the motor compartment 205. In other embodiments, the air duct 700 can be used in conjunction with other air inlets or other air outlets for other applications.

The air duct 700 includes a body 705 that is positionable over the first air inlet 231 to at least partially define a first opening 703 and a second opening 704. The first opening 703 is perpendicular to a first direction 701 and has an opening dimension 706. The second opening 704 is perpendicular to a second direction 702 that is at least approximately perpendicular to the first direction 701. Accordingly, air flowing into the air duct 700 through the first opening 703 undergoes approximately a 90° direction change before exiting into the motor compartment 205 through the second opening 704.

In one aspect of this embodiment, the body 705 further defines an overall first body dimension 721 in the first direction 701 and an overall second body dimension 722 in the second direction 702. In a further aspect of this embodiment, the first dimension 721 is less than the opening dimension 706, and the second dimension 722 is greater than the opening dimension. In other embodiments, the first and second dimensions 721 and 722 can have other sizes relative to the opening dimension 706.

The air duct 700 can include various features to enhance flow performance or reduce acoustic noise in accordance with the present invention. For example, the air duct 700 can include a filter member 712, such as a mesh or a grate, at least substantially disposed over the first opening 703 to prevent the ingress of foreign objects into the motor compartment 205. The air duct 700 can also include an elongate flow splitter 710 longitudinally disposed adjacent to the second opening 704 parallel to the second direction 702 to reduce acoustic noise associated with airflow. Similarly, insulation 730 can be affixed to the flow splitter 710 and to various portions of the body 705, such as the interior of the body, to further reduce acoustic noise.

A number of advantages are associated with the air duct 700. For example, the low profile of the air duct 700 relative to the cross section of the container 202 enables an operator (not shown) to move freely about the motor compartment 205 with full access to the generator 220. A second advantage of the air duct 700 is the noise attenuation characteristics it provides. The change in direction of the airflow from the first direction 701 to the second direction 702, in conjunction with the insulation 730 and the flow splitter 710, reduces the flow speed of the incoming air and absorbs the resulting acoustic noise. These features contribute to the relatively low overall sound pressure levels generated by the portable power module 200 during normal operation.

Figure 8A:
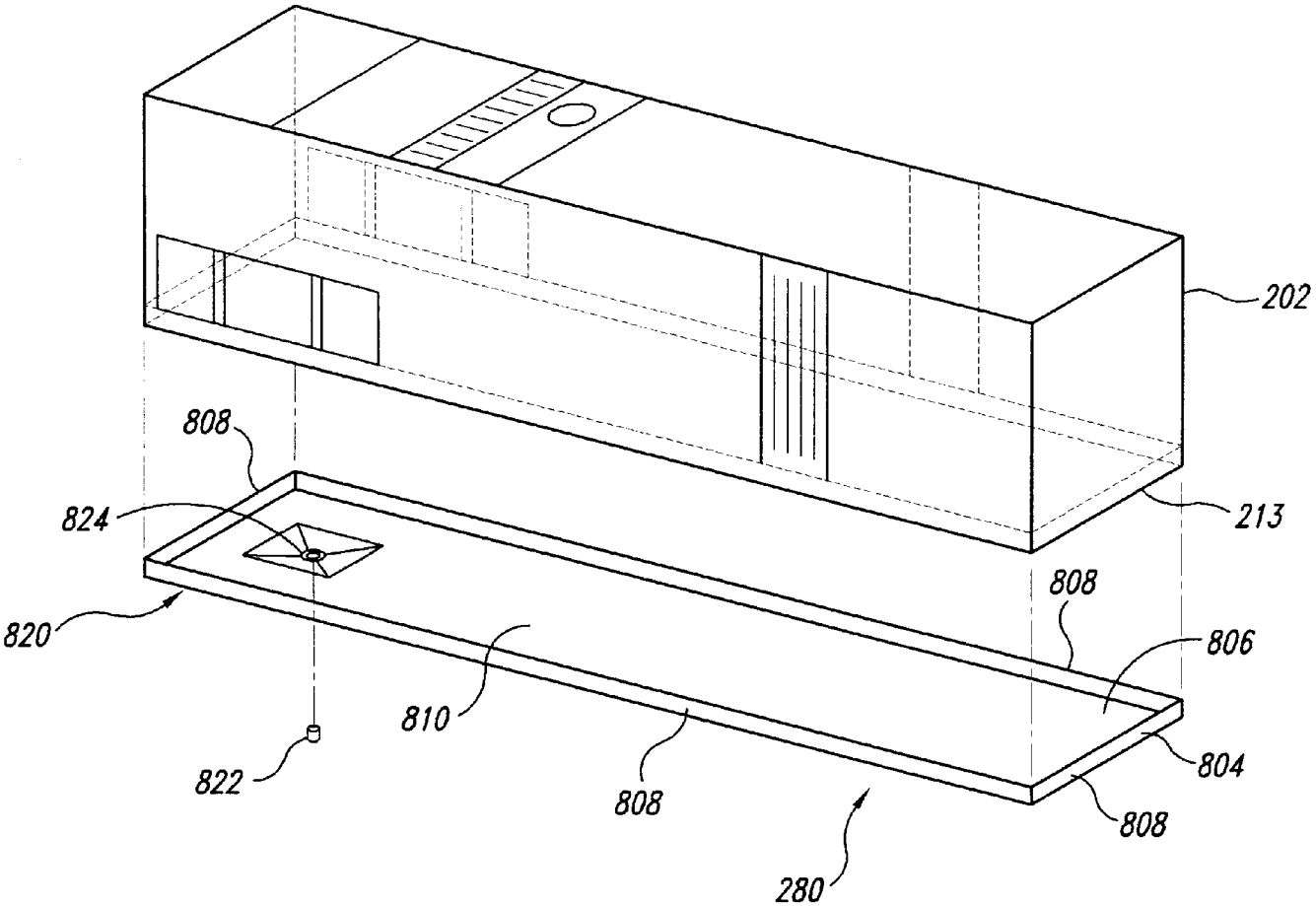
FIG. 8A is an exploded isometric view of a containment system in accordance with an embodiment of the invention.

FIG. 8A is an exploded isometric view of the containment system 280 in accordance with an embodiment of the invention. The containment system 280 includes a containment member 804 having a base portion 806 and a plurality of upstanding portions 808 contiguously and sealably attached to the base portion around the perimeter of the base portion. In one embodiment, the base portion 806 is a substantially horizontal portion and the upstanding portions 808 extend substantially vertically upward from the perimeter of the base portion. The base portion 806 and the upstanding portions 808 together define a containment volume 810 associated with the containment member 804.

The containment member 804 is shown outside the container 202 in exploded form in FIG. 8A for purposes of clarity. In practice, however, the containment member is at least generally positioned inside the container 202 adjacent to the bottom portion 213. In one aspect of this embodiment, the containment member 804 extends at least substantially over the entire bottom portion 213 inside the container 202 conforming to the interior dimensions of the container. In other embodiments, the containment member can extend over more or less of the bottom portion. For example, the containment member 804 can be divided into two or more sections positioned in various locations around the bottom portion 213 as required to meet the needs of a particular application.

In a further aspect of this embodiment, the containment member 804 is shaped and sized so that the containment volume 810 can contain at least approximately 120 percent of the liquids onboard the portable power module 200 (FIG. 2) during normal operation. Such liquids may include coolants, lubricants, and water that has either condensed inside the container 202 or has entered through one of the existing apertures. The capability to contain 120 percent of the liquids onboard the portable power provides a 20 percent margin in the event a total loss of all liquids occurs. In other embodiments, the containment member 804 can be shaped and sized to other criteria as required by the particular application. For example, in other embodiments, the containment volume can contain approximately 110%–140% of the onboard liquids.

In one embodiment, the containment system 280 can also include one or more drain outlets, such as a drain plug assembly 820, for draining liquids and other substances (not shown) that collect in the containment member over time. The drain plug assembly 820 in one embodiment may include a threaded drain plug 822 optionally threadable into a complimentary threaded drain hole 824. When the drain plug 822 is threaded into the drain hole 824, the drain plug assembly 820 is closed such that the contents of the containment member 804 are retained. When the drain plug 822 is removed from the drain hole 824, the drain plug assembly is open such that the contents of the containment member 804 are allowed to drain into a suitable receptacle (not shown). In other embodiments, other types of drain outlets may be employed. For example, one or more valves or petcocks optionally positionable between open and closed positions may be affixed to the containment member 804 for draining collected contents into suitable receptacles. In yet other embodiments, the containment system 280 can be provided without any drain outlets, and thus any collected contents can be removed by other means.

Figure 8B:
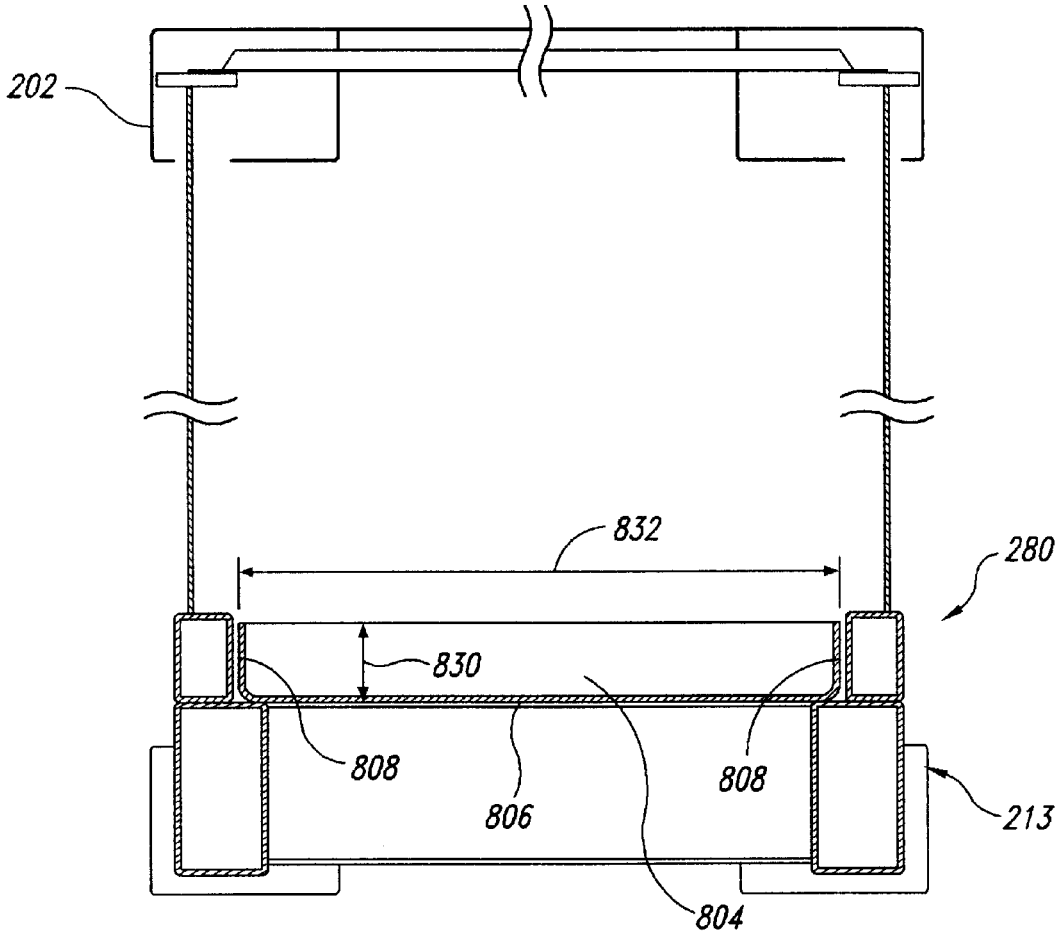
FIG. 8B is an enlarged cross-sectional view of the containment system of FIG. 8A taken substantially along line 8B—8B in FIG. 6.

FIG. 8B is an enlarged cross-sectional view taken substantially along line 8B—8B in FIG. 6 for the purpose of illustrating features of the containment system 280 in accordance with an embodiment of the invention. As can be seen, the containment member 804 extends at least substantially over the entire bottom portion 213 of the container 202 conforming to the interior dimensions of the container. In one aspect of this embodiment, the containment member has a width dimension 832 and a depth dimension 830. In the illustrated embodiment, in which the container 202 has dimensions at least substantially equivalent to a standard 40-foot ISO shipping container, the width dimension 832 is between 88.0 and 91.0 inches and the depth dimension is between 2.0 and 4.0 inches. For example, in one aspect of this embodiment, the width dimension is 89.4 inches and the depth dimension is 2.76 inches. In other embodiments, the containment member can have other dimensions.

In a further aspect of this embodiment, the containment member 804 can be fabricated from sheet metal, such as seamless folded carbon steel, and suitably attached to the bottom portion 213 of the container 202. For example, in one embodiment, the horizontal portion 806 of the containment member can be carbon steel sheet welded to the vertical portions 808 which are also carbon steel sheet. In one aspect of this embodiment, the containment member 804 can then be welded to adjacent structural members of the bottom portion 213 to secure the containment member in the container 202.

Typical portable power modules lack comprehensive containment systems to capture leaking on-board liquids and other substances. As a result, such liquids may leak out of the module over time, creating unsightly deposits on surrounding grounds. These deposits may potentially have undesirable effects on the environment. One advantage of the containment system 280 over prior art portable power modules is that it can substantially prevent lubricants, coolants, and other undesirable substances from escaping the container 202 and spilling onto adjacent land, thereby avoiding any potentially undesirable effects.

From the foregoing, it will be appreciated that specific embodiments of the invention have been described herein for purposes of illustration, but that various modifications may be made without deviating from the spirit and scope of the invention. Accordingly, the invention is not limited except by the appended claims.

I claim:

1. A containment system for use with a portable power module trailerable over public roads, the portable power module including a motor drivably connected to an electrical generator configured to produce at least approximately one megawatt of electrical power, the motor including a combustion chamber and a coolant jacket positioned adjacent to the combustion chamber to circulate liquid coolant, the portable power module further including a radiator and an exhaust gas silencer, the radiator connected in flow communication with the coolant jacket to receive the coolant from the coolant jacket and return the coolant to the coolant jacket, the exhaust gas silencer connected in flow communication with the combustion chamber to receive exhaust gases from the combustion chamber and discharge the exhaust gases, the portable power module further including a container having a first side portion spaced apart from an opposing second side portion and a bottom portion spaced apart from an opposing top portion, the bottom and top portions being at least partially interposed between the first and second side portions, wherein the portable power module has liquids onboard during normal operation comprising the liquid coolant, motor lubricants, and water, the containment system comprising:

at least a first containment member positionable adjacent to the bottom portion of the container, wherein the motor, the generator, the radiator and the exhaust gas silencer are installed in the container when the portable power module is in a normal operating configuration, the first containment member including:

a base portion; and a plurality of upstanding portions contiguously and sealably attached to the base portion around the perimeter of the base portion to avoid spillage of liquids from the container; and a drain plug assembly positioned adjacent to the base portion of the first containment member, the drain plug assembly including:

a threaded drain outlet; and a complimentary threaded drain plug, the threaded drain plug being threadably engageable with the threaded drain outlet to retain the liquids in the containment member, wherein disengaging the threaded drain plug from the threaded drain outlet allows the liquids to drain out of the containment member.

2. A containment system for use with a portable power module trailerable over public roads, the portable power module including a motor drivably connected to an electrical generator configured to produce at least approximately one megawatt of electrical power, the motor including a combustion chamber and a coolant jacket positioned adjacent to the combustion chamber to circulate liquid coolant, the portable power module further including a radiator and an exhaust gas silencer, the radiator connected in flow communication with the coolant jacket to receive the coolant from the coolant jacket and return the coolant to the coolant jacket, the exhaust gas silencer connected in flow communication with the combustion chamber to receive exhaust gases from the combustion chamber and discharge the exhaust gases, the portable power module further including a container having a first side portion spaced apart from an opposing second side portion and a bottom portion spaced apart from an opposing top portion, the bottom and top portions being at least partially interposed between the first and second side portions, wherein the portable power module has liquids on-board during normal operation including the liquid coolant, motor lubricants, and water, the containment system comprising:

at least a first containment member positionable adjacent to the bottom portion of the container, wherein the motor, the generator, the radiator and the exhaust gas silencer are installed in the container when the portable power module is in a normal operating configuration, the first containment member including:

a base portion; and a plurality of upstanding portions contiguously and sealably attached to the base portion around the perimeter of the base portion to avoid spillage of liquids from the container; and a drain outlet positioned on the base portion of the first containment member, the drain outlet being selectively configurable in a closed configuration in which the liquids are retained in the containment member or in an open configuration in which the liquids are allowed to drain out of the containment member.

3. The containment system of claim 2 wherein the base portion is substantially horizontal and the upstanding portions extend substantially vertically upward around the perimeter of the base portion.

4. The containment system of claim 2 wherein the plurality of upstanding portions are contiguously and sealably attached to the base portion around the perimeter of the base portion to define a containment volume, and wherein the containment volume can contain approximately 120% of the liquids onboard the portable power module during normal operation.

5. The containment system of claim 2 wherein the first containment member is received within the container and extends at least approximately over the entire bottom portion of the container at least substantially conforming to the interior dimensions of the container, wherein the first containment member further comprises:

a width dimension between 88.0 and 91.0 inches; and a depth dimension between 2.0 and 4.0 inches.

6. A portable power module trailerable over public roads and capable of providing at least approximately one megawatt of electrical power in a normal operating configuration, the portable power module comprising:

a shipping container defining a first interior portion toward a first direction and a second interior portion toward a second direction opposite to the first direction, the container including a first side portion spaced apart from an opposing second side portion and a bottom portion spaced apart from an opposing top portion, the bottom and top portions being at least partially interposed between the first and second side portions;

a gaseous fuel motor positioned within the first interior portion, the motor having a combustion air intake in flow communication with a combustion chamber and a coolant jacket positioned adjacent to the combustion chamber to circulate liquid coolant;

an electrical generator positioned within the first interior portion and drivably connected to the motor to produce at least one megawatt of electrical power when driven by the motor at a selected RPM, the generator including a generator air intake configured to receive cooling air;

a radiator positioned within the second interior portion in flow communication with the coolant jacket, the radiator configured to receive the liquid coolant from the coolant jacket and return the coolant to the coolant jacket;

an exhaust gas silencer positioned within the container and having an exhaust gas outlet positioned on the top portion of the container, the exhaust gas silencer connected in flow communication with the combustion chamber and configured to receive exhaust gases from the combustion chamber and vertically discharge the exhaust gases through the exhaust gas outlet;

a containment member including a base portion positioned adjacent to the bottom portion of the container underneath the motor, the generator, the radiator and the exhaust gas silencer, the containment member further including a plurality of upstanding portions contiguously and sealably attached to the base portion around the perimeter of the base portion to avoid spillage of liquids from the container;

onboard liquids including the liquid coolant, motor lubricants, and water that may reside in the portable power module during normal operation, wherein the plurality of upstanding portions of the containment member are contiguously and sealably attached to the base portion around the perimeter of the base portion to define a containment volume that can contain a portion of the onboard liquids; and a drain plug assembly including a drain hole and a mating drain plug, the mating drain plug being coupled with the drain hole to retain the portion of onboard liquids in the containment member, the mating drain plug being optionally decoupled from the drain hole to allow the portion of onboard liquids to drain out of the containment member.

7. A method for preventing liquids onboard a portable power module from spilling onto adjacent property, the portable power module being trailerable over public roads and including a motor drivably connected to an electrical generator configured to produce at least approximately one megawatt of electrical power, the motor including a combustion chamber and a coolant jacket positioned adjacent to the combustion chamber to circulate liquid coolant, the portable power module further including a radiator and an exhaust gas silencer, the radiator connected in flow communication with the coolant jacket to receive the coolant from the coolant jacket and return the coolant to the coolant jacket, the exhaust gas silencer connected in flow communication with the combustion chamber to receive exhaust gases from the combustion chamber and discharge the exhaust gases, the portable power module further including a container having a bottom portion, the method comprising:

providing a containment member, the containment member including a base portion and a plurality of upstanding portions contiguously and sealably attached to the base portion around the perimeter of the base portion;

positioning the containment member adjacent to the bottom portion of the container underneath the motor, the generator, the radiator and the exhaust gas silencer, wherein the motor, the generator, the radiator and the exhaust gas silencer are installed in the container when the portable power module is in a normal operating configuration;

affixing the containment member to the container;

providing a drain outlet adjacent to the base portion of the containment member, the drain outlet being selectively configurable in a closed configuration in which the onboard liquids can be retained in the containment member or in an open configuration in which the onboard liquids can be drained from the containment member; and configuring the drain outlet in the closed configuration.

8. A portable power module trailerable over public roads and capable of providing at least approximately one megawatt of electrical power in a normal operating configuration, the portable power module comprising:

a shipping container defining a first interior portion toward a first direction and a second interior portion toward a second direction opposite to the first direction, the container including a first side portion spaced apart from an opposing second side portion and a bottom portion spaced apart from an opposing top portion, the bottom and top portions being at least partially interposed between the first and second side portions;

a gaseous fuel motor positioned within the first interior portion, the motor having a combustion air intake in flow communication with a combustion chamber and a coolant jacket positioned adjacent to the combustion chamber to circulate liquid coolant;

an electrical generator positioned within the first interior portion and drivably connected to the motor to produce at least one megawatt of electrical power when driven by the motor at a selected RPM, the generator including a generator air intake configured to receive cooling air;

a radiator positioned within the second interior portion in flow communication with the coolant jacket, the radiator configured to receive the liquid coolant from the coolant jacket and return the coolant to the coolant jacket;

an exhaust gas silencer positioned within the container and having an exhaust gas outlet positioned on the top portion of the container, the exhaust gas silencer connected in flow communication with the combustion chamber and configured to receive exhaust gases from the combustion chamber and vertically discharge the exhaust gases through the exhaust gas outlet;

a containment member including a base portion positioned adjacent to the bottom portion of the container underneath the motor, the generator, the radiator and the exhaust gas silencer, the containment member further including a plurality of upstanding portions contiguously and sealably attached to the base portion around the perimeter of the base portion to avoid spillage of liquids from the container; and a drain outlet positioned on the base portion of the containment member, the drain outlet being selectively configurable in a closed configuration in which the liquids are retained in the containment member or in an open configuration in which the liquids are allowed to drain out of the containment member.

9. The portable power module of claim 8 further comprising:

onboard liquids including the liquid coolant, motor lubricants, and water that may reside in the portable power module during normal operation, wherein the plurality of upstanding portions of the containment member are contiguously and sealably attached to the base portion around the perimeter of the base portion to define a containment volume that can contain approximately 120% of the onboard liquids.

10. The portable power module of claim 8 wherein the containment member is received within the container and configured to extend at least substantially over the entire bottom portion of the container at least substantially conforming to the interior dimensions of the container, wherein the containment member further comprises:

a width dimension between 88.0 and 91.0 inches; and a depth dimension between 2.0 and 4.0 inches.

11. The portable power module of claim 8 wherein the container has an overall length dimension of about 40 feet or less, an overall width dimension of about 8 feet or less, and an overall height dimension of about 8.5 feet or less.

12. The portable power module of claim 8 wherein the combustion chamber is configured to combust a fuel mixture comprising natural gas.

13. The portable power module of claim 8 wherein the generator produces at least approximately one megawatt of electrical power between 50 Hz and 60 Hz when driven by the motor between 1500 and 1800 RPM.

14. The portable power module of claim 8 further comprising a trailer supporting the container and its contents, the trailer having a tandem axle rear wheel-set and a forward coupling, the coupling being releasably attachable to a transport vehicle for movement of the portable power module.

15. The portable power module of claim 8 further comprising:

a first air circuit including a first air inlet positioned on the container adjacent to the first interior portion to provide an ambient first air portion to the first interior portion at least substantially to the exclusion of the second interior portion; and a second air circuit including a second air inlet positioned on the container adjacent to the second interior portion to provide an ambient second air portion to the second interior portion at least substantially to the exclusion of the first interior portion.

16. The portable power module of claim 15 wherein the first air inlet is positioned on one of the first or second side portions, wherein the second air inlet is positioned on one of the first or second side portions, and wherein the portable power module further comprises:

a first air outlet positioned on the top portion of the container to vertically discharge at least a fraction of the first air portion; and a second air outlet positioned on the top portion of the container to vertically discharge at least a fraction of the second air portion.

17. The portable power module of claim 15 wherein the first air portion provides ambient air to the combustion air intake and the generator air intake, and wherein the second air portion provides ambient air proximate to the radiator to cool the coolant received from the coolant jacket.

18. The portable power module of claim 15 wherein the first air inlet is positioned on one of the first or second side portions, wherein the second air inlet is positioned on one of the first or second side portions, and wherein the portable power module further comprises:

a first air outlet positioned on the top portion of the container to vertically discharge at least a fraction of the first air portion;

a second air outlet positioned on the top portion of the container to vertically discharge at least a fraction of the second air portion;

a first air moving system, the first air moving system including a first fan positioned in flow communication with the first air outlet to move at least a fraction of the first air portion from the first interior portion through the first air outlet; and a second air moving system, the second air moving system including a horizontally situated second fan in flow communication with the second air outlet to move at least a fraction of the second air portion from the second interior portion, over the radiator, and through the second air outlet.

19. The portable power module of claim 15 further comprising an air inlet duct having a body positionable within the first interior portion in flow communication with the first air inlet to at least partially define a first opening parallel to the first direction and a second opening at an angle to the first direction, the body further defining an overall first body dimension perpendicular to the first direction and an overall second body dimension parallel to the first direction, the first body dimension being less than the second body dimension.

20. The portable power module of claim 15 further comprising an air inlet duct, the air inlet duct including:

a body positionable within the first interior portion in flow communication with the first air inlet to at least partially define a first opening parallel to the first direction and a second opening at an angle to the first direction, the body further defining an overall first body dimension perpendicular to the first direction and an overall second body dimension parallel to the first direction, the first body dimension being less than the second body dimension; and a flow splitter having an elongate cross-section oriented parallel to the first direction and disposed adjacent to the second opening.

* * * * *